US009513020B2

(12) United States Patent
Ikeda et al.

(10) Patent No.: US 9,513,020 B2
(45) Date of Patent: Dec. 6, 2016

(54) AIR-CONDITIONING APPARATUS

(75) Inventors: Takashi Ikeda, Tokyo (JP); Koji Yamaguchi, Tokyo (JP); Masatomo Hatta, Tokyo (JP); Masahiko Takagi, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 92 days.

(21) Appl. No.: 13/820,852

(22) PCT Filed: Oct. 4, 2011

(86) PCT No.: PCT/JP2011/005596

§ 371 (c)(1),
(2), (4) Date: Mar. 5, 2013

(87) PCT Pub. No.: WO2012/046438

PCT Pub. Date: Apr. 12, 2012

(65) Prior Publication Data

US 2013/0167578 A1 Jul. 4, 2013

(30) Foreign Application Priority Data

Oct. 4, 2010 (JP) ..... 2010-224829

(51) Int. Cl.
*F16L 57/00* (2006.01)
*F24F 13/32* (2006.01)
(Continued)

(52) U.S. Cl.
CPC ..... *F24F 1/027* (2013.01); *F24F 1/0014* (2013.01); *F24F 13/22* (2013.01); *F24F 13/14* (2013.01);
(Continued)

(58) Field of Classification Search
CPC ..... F24F 1/0014; F24F 1/027; F24F 13/22; F24F 2013/221; F24F 2001/0037; F24F 2013/0616; F24F 13/14; F24F 13/32; F24F 13/20; F16L 57/00; Y10S 62/16
(Continued)

(56) References Cited

U.S. PATENT DOCUMENTS 4,966,009 A * 10/1990 Ishii ..... F24F 1/0007 454/236
5,547,018 A * 8/1996 Takahashi ..... F24F 1/0011 165/122
(Continued)

FOREIGN PATENT DOCUMENTS

JP 05-64645 U 8/1993
JP 08-313042 A 11/1996
(Continued)

OTHER PUBLICATIONS

International Search Report of the International Searching Authority mailed Jan. 10, 2012 for the corresponding international application No. PCT/JP2011/005596 (with English translation).
(Continued)

*Primary Examiner* — Frantz Jules
*Assistant Examiner* — Martha Tadesse
(74) *Attorney, Agent, or Firm* — Posz Law Group, PLC

(57) ABSTRACT

There has been a problem of dew condensation, during a cooling operation, on a wind vane or the like provided at an air outlet because the wind speed of blown air leaking from ends in longitudinal direction of the air outlet is low, causing the entanglement of room air. Walls that form an air outlet from which air that has exchanged heat in a heat exchanger is blown are provided. End portions of each of the walls in a longitudinal direction of the air outlet have respective
(Continued)

recesses such that a passage of the air therein is made wider than in a central portion of the wall. In the longitudinal direction of the air outlet, the recesses each have a downstream-side width that is smaller than an upstream-side width.

14 Claims, 4 Drawing Sheets

(51) Int. Cl.

| | |
|---|---|
| ***F24F 13/20*** | (2006.01) |
| ***F24F 1/02*** | (2011.01) |
| ***F24F 1/00*** | (2011.01) |
| ***F24F 13/22*** | (2006.01) |
| *F24F 13/14* | (2006.01) |
| *F24F 13/06* | (2006.01) |

(52) U.S. Cl.
CPC *F24F 2001/0037* (2013.01); *F24F 2013/0616* (2013.01); *F24F 2013/221* (2013.01)

(58) Field of Classification Search
USPC ..... 62/411; 165/53, 123–124, 126, 96
See application file for complete search history.

(56) References Cited

U.S. PATENT DOCUMENTS 5,577,958 A * 11/1996 Kumekawa ..... F15D 1/04 454/233
5,624,313 A * 4/1997 Nonaka ..... F24F 13/075 454/202
6,250,373 B1 * 6/2001 Vecchi ..... F24F 1/0007 165/125
8,146,706 B2 * 4/2012 Katoh ..... B60H 1/00564 138/115
2008/0032618 A1 * 2/2008 Katoh ..... B60H 1/00564 454/143

FOREIGN PATENT DOCUMENTS

| | | | | |
|---|---|---|---|---|
| JP | 09-113024 | A | | 5/1997 |
| JP | 09-229403 | A | | 9/1997 |
| JP | 10-160238 | A | | 6/1998 |
| JP | 2001-254998 | A | | 9/2001 |
| JP | 2003-329295 | A | | 11/2003 |
| JP | 2004-353914 | A | | 12/2004 |
| JP | 2004353914 | A | * | 12/2004 |
| JP | 2007-024345 | A | | 2/2007 |
| JP | 2007024345 | A | * | 2/2007 |
| JP | 3957927 | B2 | | 8/2007 |
| JP | 2010-038490 | A | | 2/2010 |

OTHER PUBLICATIONS

Notification of Reasons for Refusal issued from the Japanese Patent Office dated Dec. 26, 2011 for the corresponding Japanese patent application No. 2010-224829 (with English translation).
Notice of Reasons for Rejection issued from the Japanese Patent Office dated Jul. 17, 2012 for the corresponding Japanese patent application No. 2010-224829 (with English translation).
Office Action dated Jan. 23, 2015 issued in corresponding CN patent application No. 201180048063.9 (and English translation).

* cited by examiner

AIR-CONDITIONING APPARATUS

CROSS REFERENCE TO RELATED APPLICATIONS

This application is a U.S. national stage application of PCT/JP2011/005596 filed on Oct. 4, 2011, and claims priority to, and incorporates by reference, Japanese Patent Application No. 2010-224829 filed on Oct. 4, 2010.

TECHNICAL FIELD

The present invention relates to an air-conditioning apparatus and in particular to controlling the airflow at an air outlet of an indoor unit.

BACKGROUND ART

Hitherto, air-conditioning apparatuses have employed improvements in the shapes of their air outlets or the configurations of their air-passage walls near the air outlets or by providing wind vanes at the air outlets so that dewing near the air outlets of the air-conditioning apparatuses is prevented, the sensation of airflow experienced by users is reduced, or, in the case of a ceiling-concealed air-conditioning apparatus, smudging on the ceiling is suppressed.

Such known air-conditioning apparatuses include an air-conditioning apparatus including passage-wall members that are provided on passage walls at an air outlet and enable change in the direction of blown air by undergoing warpage (see Patent Literature 1, for example). The air-conditioning apparatus disclosed by Patent Literature 1 aims to supply the flow of blown air to an area wider in the horizontal direction by increasing, in the span direction, the degree of expansion of the flow of blown air at the air outlet. To achieve this, a configuration is disclosed in which upper and lower passage-wall members include a specific region, respectively, where the distance between the upper and lower passage-wall members is gradually reduced from the upstream side toward the downstream side of blown air. The upper and lower passage-wall members are warped such that the width of the specific regions gradually increases from the upstream side toward the downstream side in the blowing direction.

Another exemplary apparatus includes air-guiding portions that guide air blown from rectangular air outlets toward the ceiling. The air-guiding portions each have a step blocking a portion of the air at a terminal end thereof. The height of the step is large at two widthwise ends of the air outlet and is gradually reduced toward the center (see Patent Literature 2, for example).

CITATION LIST

Patent Literature

Patent Literature 1: Japanese Unexamined Patent Application Publication No. 2004-353914 (paragraphs 0066 and 0067, and FIGS. 7 and 8)

Patent Literature 2: Japanese Patent No. 3957927 (paragraph 0020 and FIGS. 3 to 5)

SUMMARY OF INVENTION

Technical Problem

In the air-conditioning apparatus disclosed by Patent Literature 1, however, since the specific region whose width gradually increases from the upstream side toward the downstream side is provided in each of the passage-wall members projecting from ends of the passage walls that form the air outlet, portions of the blown air at the right and left ends in a longitudinal direction of the air outlet which have gone beyond the passage walls leak to the outside of the air-conditioning apparatus from the right and left ends of each of the passage-wall members. Hence, the wind speed of the blown air at the right and left ends in the longitudinal direction is reduced. Consequently, indoor air is entangled at the right and left ends of the passage-wall members causing dew condensation near the air outlet, which is a problem.

Meanwhile, in the air-conditioning apparatus disclosed by Patent Literature 2, since the height of the step is larger at the two ends in the longitudinal direction of the air outlet, the wind speed of air blown from the two ends of the air outlet is low. Consequently, indoor air is entangled at the two ends of the air outlet causing dew condensation near the air outlet, which is a problem.

The present invention is to solve the above problems and to suppress the occurrence of entanglement of room air caused by air blown from each end in a longitudinal direction of an air outlet, by increasing the wind speed of air blown from the ends of the air outlet.

Solution to Problem

An air-conditioning apparatus according to the present invention includes walls that form an air outlet blowing air that has exchanged heat in a heat exchanger in which two end portions of each wall in a longitudinal direction of the air outlet have respective recesses such that a passage of the air therein is made wider than in a central portion of the wall, the recesses each having a smaller width in the longitudinal direction on a downstream side of the air than on an upstream side of the air, and the air outlet is defined by an inner air-passage wall and an outer air-passage wall in the longitudinal direction and by air-outlet sidewalls in a short-side direction, the air outlet being configured such that the passage of the air is widened from the upstream side toward the downstream side of the air and is narrowed near an aperture plane of the air outlet.

Advantageous Effects of Invention

In the air-conditioning apparatus according to the present invention, the speed of the flow of air that is blown from the two longitudinal ends of the air outlet during a cooling operation is increased by utilizing the shapes of the two ends, whereby the occurrence of entanglement of room air caused by the air blown from the ends of the air outlet is suppressed, and the occurrence of dewing near the air outlet is thus suppressed.

DESCRIPTION OF EMBODIMENTS

Embodiment 1

Figure 1:
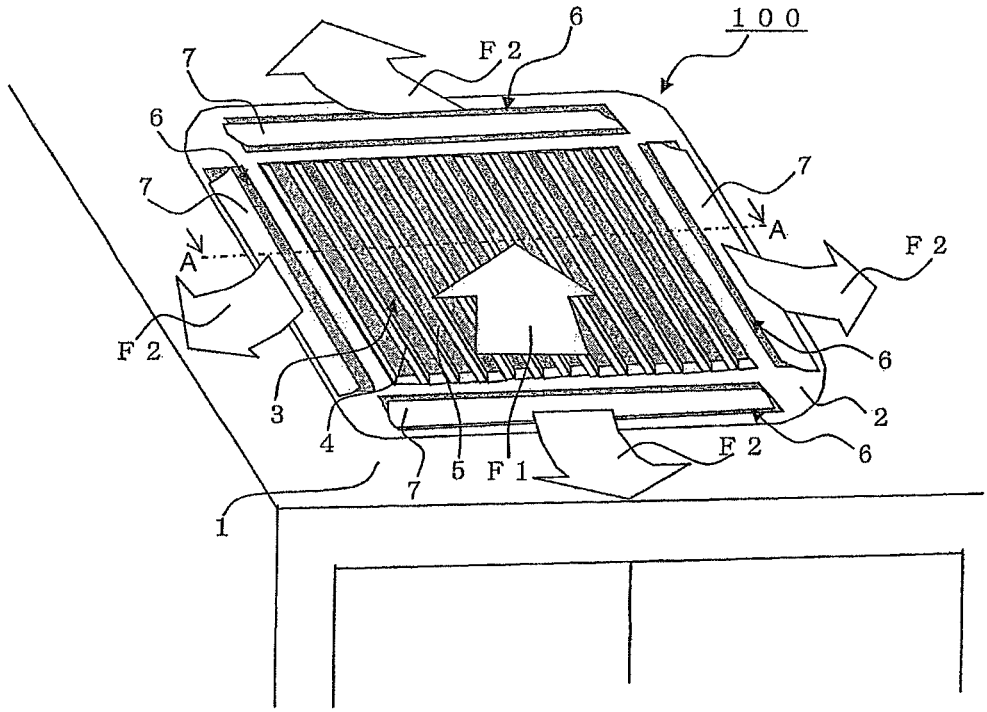
FIG. 1 is an external perspective view of an air-conditioning apparatus according to Embodiment 1 of the present invention.

An air-conditioning apparatus according to Embodiment 1 of the present invention will now be described. FIG. 1 is an external perspective view of the air-conditioning apparatus according to Embodiment 1 of the present invention.

An air-conditioning apparatus 100 according to Embodiment 1 is a ceiling-concealed air-conditioning apparatus installed in a space above a ceiling 1 of a room and having a decorative panel 2 that has a substantially square plan-view shape attached at a bottom part of the air-conditioning apparatus 100 as illustrated in FIG. 1. The decorative panel 2 extends along the ceiling 1. The apparatus has a suction grille 4 forming an air inlet 3 to the air-conditioning apparatus 100 near the center of the decorative panel 2, a filter 5 provided on the downstream side of the suction grille 4 for removing dust in the air, air outlets 6 provided along the respective sides of the decorative panel 2, and movable wind vanes 7 provided in the respective air outlets 6 for changing the direction of blown air. Suction air F1 sucked from the air inlet 3 into the air-conditioning apparatus 100 is subjected to dust removal at the filter 5, flows through the inside of the air-conditioning apparatus 100, and is blown as blown air F2 from the air outlets 6. When the air-conditioning apparatus 100 is not in operation, the wind vanes 7 are positioned in such a manner as to close the air outlets 6. When the air-conditioning apparatus 100 is activated, however, the wind vanes 7 are rotated by non-illustrated driving devices such as motors and the tips of the wind vanes 7 project from aperture planes at the air outlets 6 at this state. The blown air F2 blown from the air outlets 6 flows along the wind vanes 7. Therefore, controlling the movement of the wind vanes 7 controls the direction of the blown air F2.

Figure 2:
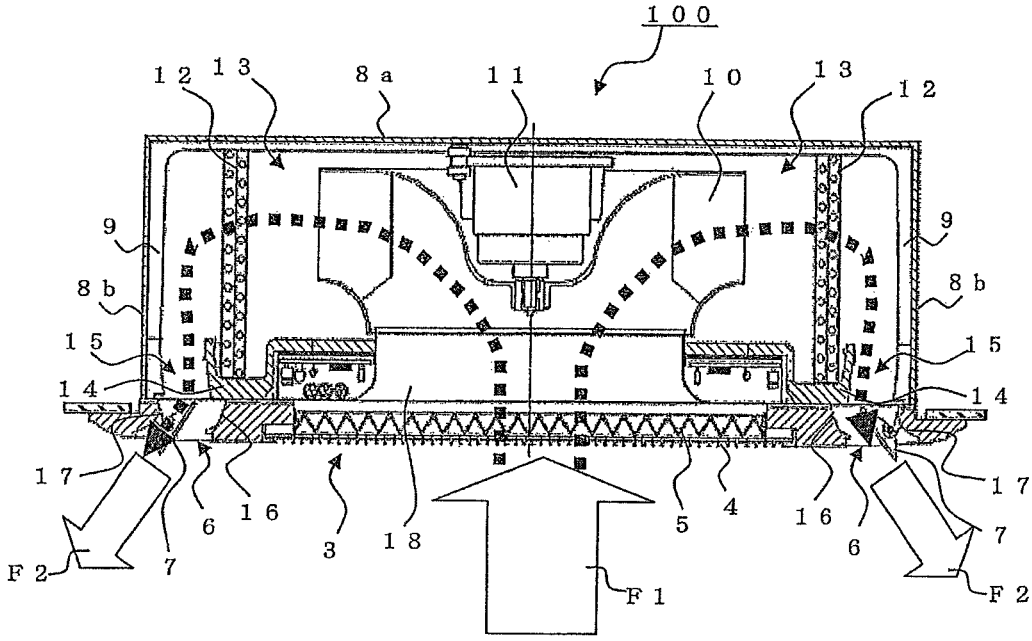
FIG. 2 is a sectional view of the air-conditioning apparatus illustrated in FIG. 1 taken along line A-A.

An internal configuration of the air-conditioning apparatus 100 will now be described with reference to FIG. 2. FIG. 2 is a sectional view of the air-conditioning apparatus illustrated in FIG. 1 taken along line A-A. An outer wall of the air-conditioning apparatus 100 has a top board 8*a* and side boards 8*b* provided therearound that form a box-like shape, and is fixed with insertion of a heat-insulating member 9 also having a box-like shape into the inside of the outer wall of the air-conditioning apparatus 100.

Furthermore, the air-conditioning apparatus 100 includes thereinside a turbofan as a fan 10, a fan motor 11 that rotates the fan 10, a heat exchanger 12 having a substantially square shape and standing around the outer circumference of the fan 10, and a drain pan 14 provided below the heat exchanger 12 and receiving condensed water resulting from dew condensation caused by air condensation occurring in the heat exchanger 12 during a cooling operation or a dehumidifying operation. Fan-outlet air passages 13 extend from the fan 10 to the heat exchanger 12 and communicate with the respective air outlets 6 of the decorative panel 2 via unit elbow air passages 15. The unit elbow air passages 15 have an elbow-like shape and are defined by the drain pan 14, the main-body top board 8*a*, and the heat-insulating member 9 extending along the side boards 8*b*.

The air outlets 6 each have a substantially oblong rectangular shape with its long side being parallel to a corresponding one of the sides of the suction grille. The air outlets 6 are each defined by an inner air-passage wall 16, which is a wall nearer to the suction grille 4, and an outer air-passage wall 17, which is farther from the suction grille 4. As illustrated in the sectional views in FIGS. 2 and 3, the inner air-passage wall 16 and the outer air-passage wall 17 define the shape of an air passage that curves toward the outer side of the unit with respect to the suction grille 4. The inner air-passage wall 16 has a substantially concave curved surface. The outer air-passage wall 17 has a substantially convex curved surface. The inner air-passage wall 16 and the outer air-passage wall 17 face each other, thereby defining the air outlet 6.

A bellmouth 18 provides an air passage extending from the filter 5 to the fan 10. The suction air F1 sucked from the air inlet 3 and the suction grille 4 flows through the filter 5 and the bellmouth 18 and is sent to the fan-outlet air passages 13 by the fan 10. The air sent to the fan-outlet air passages 13 undergoes heat exchange in the heat exchanger 12. Particularly, in Embodiment 1, it is assumed that a low-temperature refrigerant having passed through an expansion valve that is provided in a non-illustrated refrigerant circuit is flowing in the heat exchanger 12, and air in the room in which the air-conditioning apparatus 100 is installed is cooled. The air that has flowed through the heat exchanger 12 releases its heat and turns into low-temperature air. The low-temperature air flows through the unit elbow air passages 15.

Figure 3:
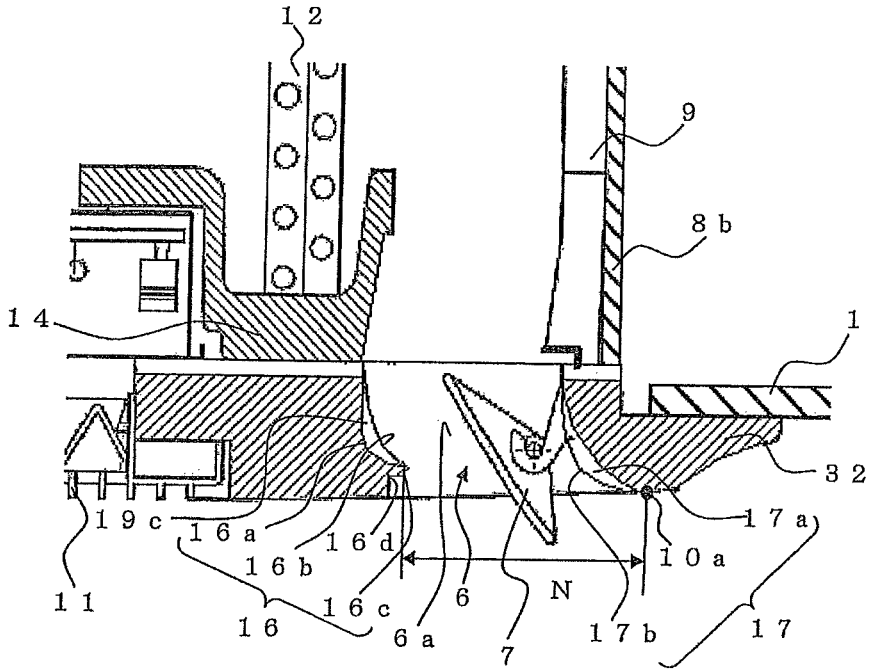
FIG. 3 is an enlarged view illustrating parts around an air outlet illustrated in FIG. 2.

Referring now to FIGS. 3 to 7, configurations around the air outlets 6 will be described. FIG. 3 is an enlarged view illustrating parts around one of the air outlets 6 illustrated in FIG. 2. In longitudinal direction of each air outlet 6, the inner air-passage wall 16 has a central portion protruding with respect to ends thereof. Specifically, the right and left ends of the inner air-passage wall 16 are denoted as inner-air-passage-wall end portions 16*a*, and the central portion of the inner air-passage wall 16 is denoted as inner-air-passage-wall central portion 16*b*. Likewise, in the longitudinal direction of each air outlet 6, the outer air-passage wall 17 has a central portion protruding with respect to ends thereof. The two ends of the outer air-passage wall 17 are denoted as outer-air-passage-wall end portions 17*a*, and the central portion of the outer air-passage wall 17 is denoted as outer-air-passage-wall central portion 17*b*. The outer-air-passage-wall end portions 17*a* and the outer-air-passage-wall central portion 17*b* face the inner-air-passage-wall end portions 16*a* and the inner-air-passage-wall central portion 16*b*, respectively, whereby the air outlet 6 is defined. The inner air-passage wall 16 has an inner-air-passage-wall downstream end portion 16*c* projecting at the inner side of the air outlet 6 at the downstream lower end thereof, and also has an inner-air-passage-wall stepped portion 16*d* on the downstream side of the inner-air-passage-wall downstream end portion 16*c*. The inner-air-passage-wall stepped portion 16*d* forms a step between the aperture plane of the air outlet 6 and the inner-air-passage-wall downstream end portion 16*c*. That is, the air outlet 6 is defined by the inner air-passage wall 16 and the outer air-passage wall 17 in the longitudinal direction and by air-outlet sidewalls 6*a* in the short-side direction. The air-outlet sidewalls 6*a* form surfaces that connect the inner air-passage wall 16 and the outer air-passage wall 17 and are parallel to the section taken along line A-A. The air outlet 6 is provided with the wind vane 7. The wind vane 7 is rotated by the non-illustrated driving motor. When the air-conditioning apparatus 100 is in operation, the tip of the wind vane 7 projects from the aperture plane of the air outlet 6.

Figure 4:
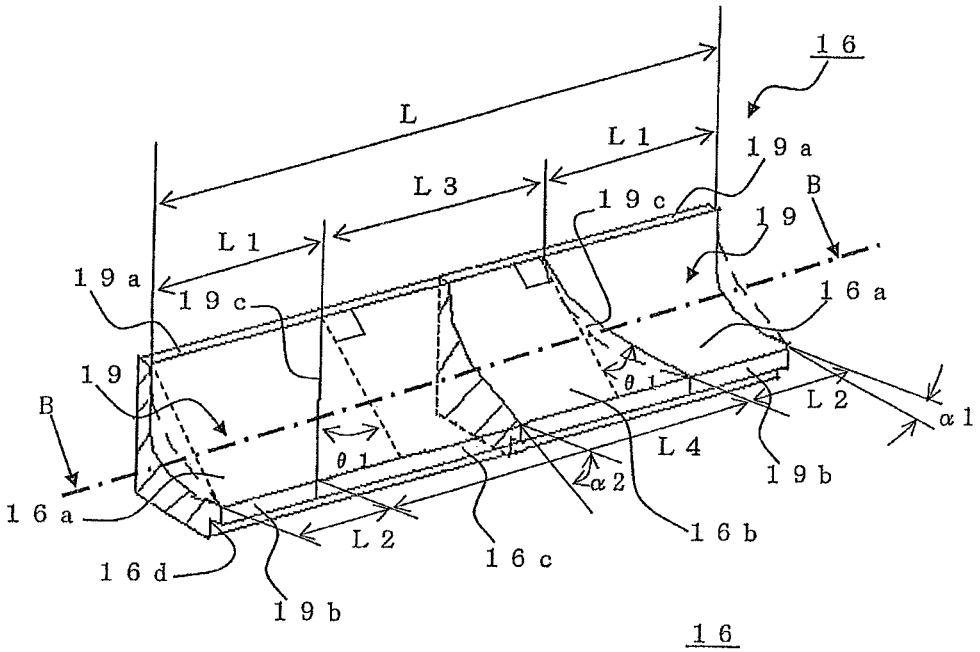
FIG. 4 is a perspective view of an inner air-passage wall illustrated in FIG. 3.
Figure 5:
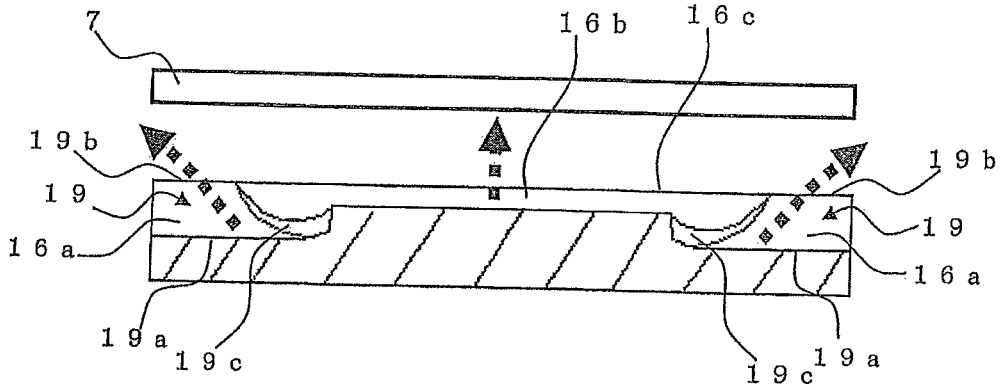
FIG. 5 is a sectional view of the inner air-passage wall illustrated in FIG. 4 taken along line B-B.

FIG. 4 is a perspective view of the inner air-passage wall illustrated in FIG. 3. FIG. 5 is a sectional view of the inner air-passage wall illustrated in FIG. 4 taken along line B-B and seen in the direction of arrows. As illustrated in FIG. 4, the inner-air-passage-wall downstream end portion 16*c* of the inner air-passage wall 16 extends substantially linearly, and the inner-air-passage-wall end portions 16*a* on the right and left sides in the longitudinal direction of the inner air-passage wall 16 have inner-air-passage-wall recesses 19, respectively, with which the air passage at the air outlet 6 is partially widened in the direction of a short-side length N of the air outlet with respect to the inner-air-passage-wall central portion 16*b*. In each of the inner-air-passage-wall recesses 19, an upstream longitudinal length L1 of an inner-air-passage-wall-recess starting end 19*a* of the inner air-passage wall 16 that is on the upstream side of the blown air F2 and a downstream longitudinal length L2 of an inner-air-passage-wall-recess terminal end 19*b* of the inner-air-passage-wall recess are expressed as a relationship of length L1>length L2. The width of the inner-air-passage-wall recess is continuously reduced from the upstream side toward the downstream side of the air outlet. The wall of each inner-air-passage-wall end portion 16*a* forms a curved surface that is continuously concave from the inner-air-passage-wall-recess starting end 19*a* to the inner-air-passage-wall-recess terminal end 19*b*. The length L1 corresponds to the length of one side of the inner-air-passage-wall end portion 16*a* that is at the upstream end and is parallel to the longitudinal direction of the air outlet 6. The length L2 corresponds to the length of one side of the inner-air-passage-wall end portion 16*a* that is at the downstream end and is parallel to the longitudinal direction of the air outlet 6.

As illustrated in FIG. 4, letting the longitudinal length of the inner air-passage wall 16 be a length L, a length L3 of the inner-air-passage-wall central portion 16*b* at its upstream starting end is expressed as L3=L−2×L1, and a length L4 of the inner-air-passage-wall central portion 16*b* at the downstream terminal end is expressed as L4=L−2×L2.

As illustrated in FIG. 4, an inner-air-passage-wall-recess sidewall 19*c* extends at an angle of inclination θ1 (0<θ1<90) with respect to a straight line connecting the inner-air-passage-wall-recess starting end 19*a* and the inner-air-passage-wall downstream end portion 16*c* in the short-side direction of the air outlet 6 and being orthogonal to the longitudinal direction of the air outlet 6. As illustrated in FIG. 4, the inner-air-passage-wall-recess starting end 19*a* is parallel to the longitudinal direction of the inner air-passage wall 16, and the inner-air-passage-wall end portions 16*a* are together configured such that the air passage is widened.

Furthermore, the inner-air-passage-wall end portions 16*a* are configured such that the air passage is first widened from the upstream side toward the downstream side of the blown air F2 and is then narrowed. A blowing angle α1 that is an angle between the inner air-passage wall 16 and the horizontal direction at each inner-air-passage-wall downstream end portion 16*c* is smaller than a blowing angle α2 at the inner-air-passage-wall central portion 16*b*. Hence, the blown air flowing along the inner air-passage wall 16 is made to flow toward the surface of the wind vane 7.

Since the inner air-passage wall 16 is configured as described above, when air having exchanged heat is blown from the air outlet 6, the air is blown obliquely outward in such a manner as to be widened in the longitudinal direction of the air outlet 6 at, in particular, the inner-air-passage-wall-recess terminal ends 19*b* among the inner-air-passage-wall downstream end portion 16*c*.

Hence, since the speed of the blown air F2 that is blown out from the two ends in the longitudinal direction of the air outlet 6 around the wind vane 2, which is used to be slow in the known art, is increased and the surface speed on the wind vane 7 is also increased, entanglement of room air having high temperature and high humidity and entangling from the horizontal direction with respect to the air outlet 6 and the wind vane 7 decreases, whereby the occurrence of dewing around the air outlet 6 and on the wind vane 7 in a cooling operation is prevented. Moreover, the occurrence of dew condensation in the air-conditioning apparatus 100 and the occurrence of contamination and the growing of mold on the ceiling of the room in which the air-conditioning apparatus 100 is installed are prevented. Therefore, the lives of the air-conditioning apparatus 100 and room materials are extended.

Consequently, a high-quality, highly reliable air-conditioning apparatus with improved comfort is provided.

If the angle of inclination θ1 of each of the inner-air-passage-wall-recess sidewalls 19*c* of the inner air-passage wall 16 is small, the airflow is difficult to be widened outward. If the angle of inclination θ1 is too large, the inner-air-passage-wall-recess sidewall 19*c* will be a drag, making the airflow that goes over the step so large as to disturb the blown air. Therefore, an effective range of angle of inclination θ1 is 20° to 60°.

As illustrated in FIGS. 4 and 5, the inner-air-passage-wall recesses 19 each have a curved surface that is continuously concave from the inner-air-passage-wall-recess starting end 19*a* to the inner-air-passage-wall-recess terminal end 19*b*, whereby the air passage is partially widened at the inner-air-passage-wall recess 19, and the airflow gathers toward the inner-air-passage-wall-recess sidewall 19*c*. Hence, the wind speed of the blown air F2 from the two ends in the longitudinal direction of the air outlet 6 is increased. Consequently, the occurrence of entanglement of room air near the air outlet 6 is suppressed, whereby the occurrence of dew condensation is prevented.

Figure 6:
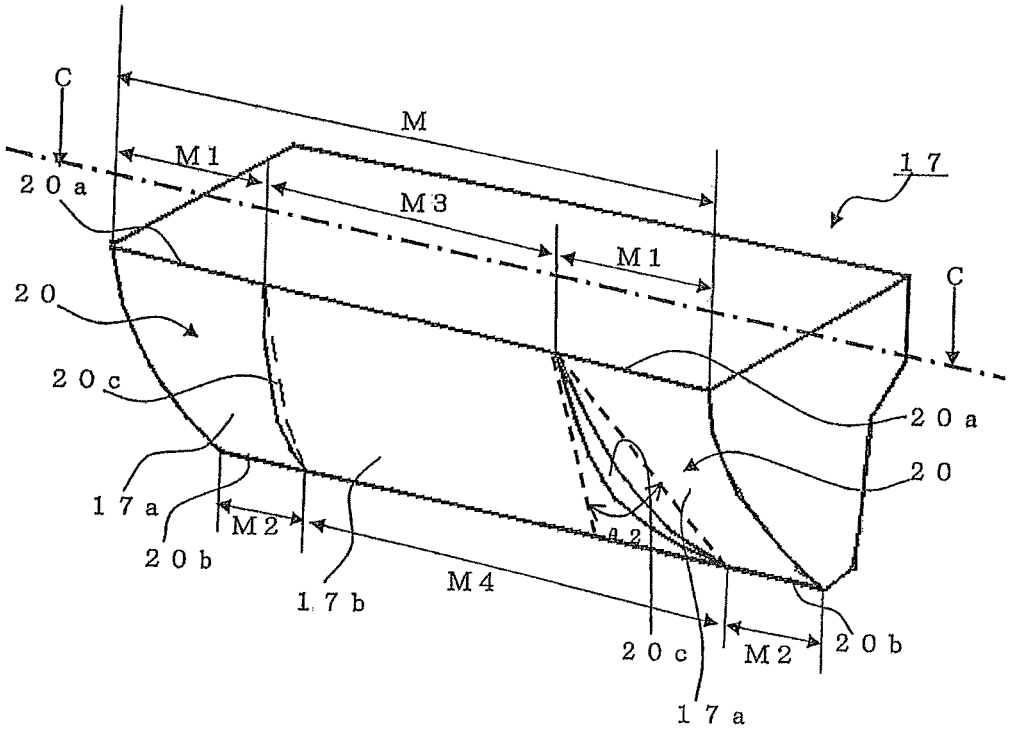
FIG. 6 is a perspective view of an outer air-passage wall illustrated in FIG. 3.
Figure 7:
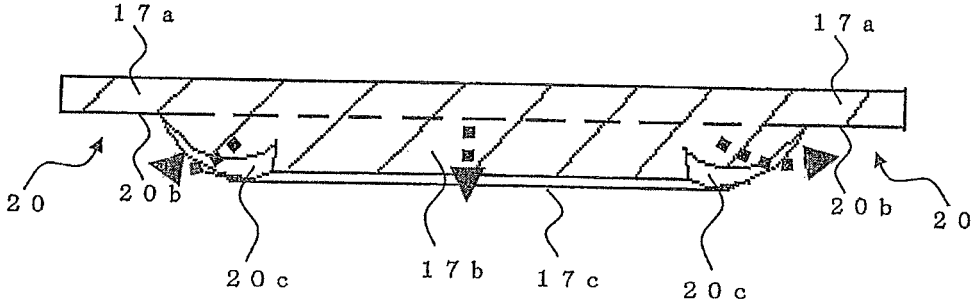
FIG. 7 is a sectional view of the outer air-passage wall illustrated in FIG. 6 taken along line B-B.

The shape of the outer air-passage wall 17 will now be described with reference to FIGS. 6 and 7. FIG. 6 is a perspective view of the outer air-passage wall 17. FIG. 7 is a sectional view of the outer air-passage wall 17 illustrated in FIG. 6 taken along line C-C and seen in the direction of arrows. As illustrated in FIG. 6, the outer-air-passage-wall end portions 17*a* provided at the right and left two ends in the longitudinal direction of the outer air-passage wall 17 have respective outer-air-passage-wall recesses 20, with which the air passage at the air outlet 6 is partially widened in the direction of the short-side length N of the air outlet 6 with respect to the outer-air-passage-wall central portion 17*b*. In each of the outer-air-passage-wall recesses 20, a step with respect to the outer-air-passage-wall central portion 17*b* is provided in such a manner as to extend from an outer-air-passage-wall-recess starting end 20*a*, which is an edge on the upstream side of the blown air F2, to an outer-air-passage-wall-recess terminal end 20*b*, which is an edge on the downstream side of the blown air F2. A wall extending between each outer-air-passage-wall end portion 17*a* and the outer-air-passage-wall central portion 17*b* corresponds to an outer-air-passage-wall-recess sidewall 20*c*.

The outer-air-passage-wall-recess sidewall 20*c* extends at an angle of inclination θ2 (0<θ2<90) with respect to a straight line connecting the outer-air-passage-wall-recess starting end 20*a* and the outer-air-passage-wall-recess terminal end 20*b* in the direction of the short-side length N of the air outlet and being orthogonal to the longitudinal direction of the air outlet. In the outer-air-passage-wall recess 20, a longitudinal length M1 of the outer-air-passage-wall-recess starting end 20*a*, which is an end of the outer air-passage wall 17 on the upstream side of the blown air F2, is larger than a longitudinal length M2 of the outer-air-passage-wall-recess terminal end 20*b*, which is an end on the downstream side. The outer-air-passage-wall recess 20 has a curved surface that is continuously concave from the upstream side toward the downstream side of the air outlet to the outer-air-passage-wall-recess terminal end 20*b*. The length M1 corresponds to the length of one side of the outer-air-passage-wall end portion 17*a* that is at the upstream end and is parallel to the longitudinal direction of the air outlet 6. The length M2 corresponds to the length of one side of the outer-air-passage-wall end portion 17*a* that is at the downstream end and is parallel to the longitudinal direction of the air outlet 6. The width of the outer-air-passage-wall recess 20 in the longitudinal direction of the air outlet 6 is continuously reduced from the upstream side toward the downstream side of the air outlet 6, and a continuously convex curved surface is formed from the outer-air-passage-wall-recess starting end 20*a* to the outer-air-passage-wall-recess terminal end 20*b*.

Letting the longitudinal length of the outer air-passage wall 17 be a length M, a length M3 of an upstream starting end of the outer-air-passage-wall central portion 17*b* is expressed as M3=M−2×M1, and a length M4 of a downstream terminal end of the outer-air-passage-wall central portion 17*b* is expressed as M−2×M2.

As illustrated in FIG. 6, the outer-air-passage-wall-recess sidewall 20*c* extends at the angle of inclination θ2 with respect to the straight line connecting the outer-air-passage-wall-recess starting end 20*a* and an outer-air-passage-wall downstream end portion 17*c* in the short-side direction of the air outlet 6 and being orthogonal to the longitudinal direction of the air outlet 6. As illustrated in FIG. 6, the outer-air-passage-wall-recess starting end 20*a* is parallel to the longitudinal direction of the outer air-passage wall 17, and the outer-air-passage-wall end portions 17*a* are together configured such that the air passage is widened.

Furthermore, the outer-air-passage-wall end portions 17*a* are configured such that the air passage is first widened from the upstream side toward the downstream side of the blown air F2 and is then narrowed.

Since the outer air-passage wall 17 is configured as described above, air having exchanged heat is blown out from the air outlet 6 obliquely outward from the two longitudinal ends of the air outlet 6 in such a manner as to be widened in the longitudinal direction. In addition, as illustrated in FIG. 6, since the air passage at the outer-air-passage-wall end portion 17*a* is widened, air flows easily. Therefore, the wind speed of the air blown from the two ends of the air outlet 6 in the longitudinal direction of the air outlet 6 is increased. This suppresses the occurrence of entanglement of room air, whereby the occurrence of dew condensation near the air outlet 6 is suppressed.

If the angle of inclination θ2 of the outer-air-passage-wall-recess sidewall 20*c* of the outer air-passage wall 17 is small, the airflow is difficult to be widened outward. If the angle of inclination θ2 is too large, the outer-air-passage-wall-recess sidewall 20*c* acts as a drag, making the airflow that goes over the step so large as to disturb the blown air. Therefore, it is effective to employ an angle from 20° to 60°, which is substantially equal to the angle of inclination θ1 in the case of the inner air-passage wall.

As illustrated in FIGS. 6 and 7, the outer-air-passage-wall recesses 20 each have a curved surface that is continuously convex from the outer-air-passage-wall-recess starting end 20*a* to the outer-air-passage-wall-recess terminal end 20*b*, whereby the air passage is partially widened at the outer-air-passage-wall recess 20, and the airflow gathers toward the outer-air-passage-wall end portion 17*a*. Hence, the wind speed of the blown air F2 from the two ends in the longitudinal direction of the air outlet 6 is increased. Consequently, the occurrence of entanglement of room air near the air outlet 6 is suppressed, whereby the occurrence of dew condensation is prevented.

If M3>M2 and M4>M1, the wind speed of the blown air F2 from the two ends of the air outlet 6 is further increased. Accordingly, the occurrence of dewing is further suppressed.

As described above, in the air-conditioning apparatus 100 according to Embodiment 1, since the wind speeds of the blown air F2 at the central portion and at the ends are made uniform, the occurrence of vertical vortices that may occur in the known art at two ends of blown air due to the difference in the wind speed in the longitudinal direction is suppressed. Accordingly, the entanglement of room air does not tend to occur. Therefore, the occurrence of dew condensation near the air outlet is prevented. Moreover, if the present invention is applied to a ceiling-concealed air-conditioning apparatus, since the occurrence of entanglement of room air at the ends of the air outlet is suppressed, the occurrence of smudging on the ceiling is also prevented and the ceiling is prevented from being contaminated. Therefore, the frequency of replacement of ceiling paper and ceiling materials is reduced. Furthermore, since the air blown from the central portion of the air outlet is also blown from the ends of the air outlet and the blown air is widened in the longitudinal direction of the air outlet, the average wind speed of the total blown air is reduced. Hence, the sensation of airflow experienced by users is suppressed. Consequently, a high-quality air-conditioning apparatus is provided.

Embodiment 2

Embodiment 1 has been described about a configuration illustrated in FIGS. 5 and 7 in which the inner-air-passage-wall-recess starting end 19*a* and the outer-air-passage-wall-recess starting end 20*a* are parallel to the longitudinal direction of the inner air-passage wall 16 and the outer air-passage wall 17, respectively. Embodiment 2 concerns a configuration in which the inner-air-passage-wall-recess starting end and the outer-air-passage-wall-recess starting end each have an inclination. In Embodiment 2, elements that are the same as those in Embodiment 1 are denoted by corresponding reference numerals, and description thereof is omitted.

Figure 8:
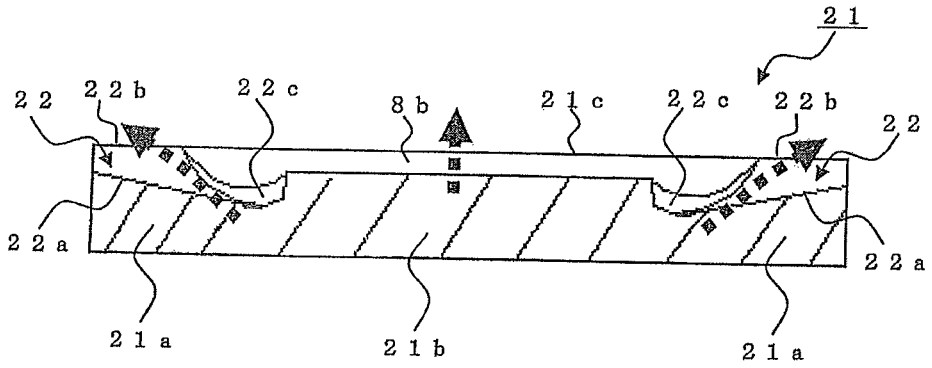
FIG. 8 is a sectional view of an inner air-passage wall according to Embodiment 2.

FIG. 8 is a sectional view of an inner air-passage wall 21 according to Embodiment 2. As with the case of Embodiment 1, in the longitudinal direction of each air outlet 6, the inner air-passage wall 21 has a central portion protruding with respect to ends thereof. That is, the right and left ends of the inner air-passage wall 21 are denoted as inner-air-passage-wall end portions 21*a*, and the central portion of the inner air-passage wall 21 is denoted as inner-air-passage-wall central portion 21*b*. An inner-air-passage-wall downstream end portion 21*c*, which is a lower edge on the downstream side of the inner air-passage wall 21, is parallel to the longitudinal direction of the inner air-passage wall 21 and is substantially linear. The inner-air-passage-wall end portions 21*a* on the right and left sides in the longitudinal direction of the inner air-passage wall 21 each have an inner-air-passage-wall recess 22, with which the air passage is partially widened in the short-side direction of the air outlet 6 with respect to the inner-air-passage-wall central portion 21*b*. An inner-air-passage-wall-recess starting end 22*a*, which is the upstream edge of the inner-air-passage-wall recess 22, inclines with respect to the longitudinal direction of the inner air-passage wall 21 such that the distance between the inner-air-passage-wall-recess starting end 22*a* and an inner-air-passage-wall-recess terminal end 22*b* is reduced toward the longitudinal end of the inner air-passage wall 21. A step is provided between each inner-air-passage-wall end portion 21*a* and the inner-air-passage-wall central portion 21*b*. An inner-air-passage-wall-recess sidewall 22*c* forms the stepped portion.

Figure 9:
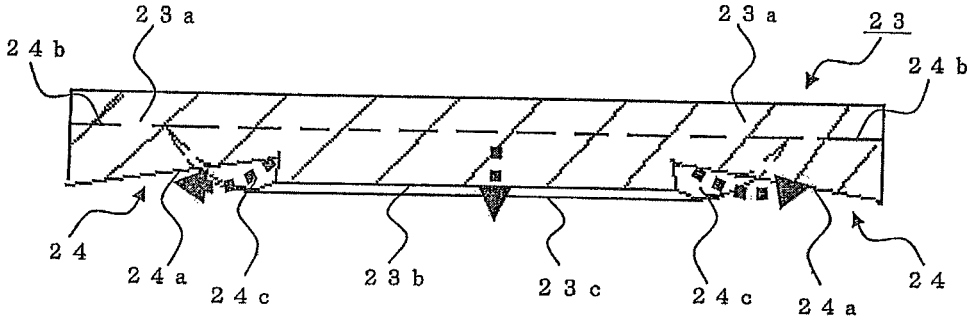
FIG. 9 is a sectional view of an outer air-passage wall according to Embodiment 2.

FIG. 9 is a sectional view of an outer air-passage wall 23 according to Embodiment 2. As with the case of Embodiment 1, in the longitudinal direction of each air outlet 6, the outer air-passage wall 23 has a central portion protruding with respect to ends thereof. That is, the right and left two ends of the outer air-passage wall 23 are denoted as outer-air-passage-wall end portions 23*a*, and the central portion of the outer air-passage wall 23 is denoted as outer-air-passage-wall central portion 23*b*. An outer-air-passage-wall downstream end portion 23*c*, which is the lower edge on the downstream side of the outer air-passage wall 23, is parallel to the longitudinal direction of the outer air-passage wall 23 and is substantially linear. The outer-air-passage-wall end portions 23*a* on the right and left sides in the longitudinal direction of the outer air-passage wall 23 each have an outer-air-passage-wall recess 24, with which the air passage is partially widened in the short-side direction of the air outlet 6 with respect to the outer-air-passage-wall central portion 23*b*. An outer-air-passage-wall-recess starting end 24*a*, which is the upstream edge of the outer-air-passage-wall recess 24, inclines with respect to the longitudinal direction of the outer air-passage wall 23 such that the distance between the outer-air-passage-wall-recess starting end 24*a* and an outer-air-passage-wall-recess terminal end 24*b* increases toward the longitudinal end of the outer air-passage wall 23. A step is provided between each outer-air-passage-wall end portion 23*a* and the outer-air-passage-wall central portion 23*b*. An outer-air-passage-wall-recess sidewall 24*c* forms the stepped portion.

As described above, in the air-conditioning apparatus according to Embodiment 2, the inner-air-passage-wall-recess starting end 22*a* inclines toward the inner-air-passage-wall central portion 16*b* with forwarding toward the end in the longitudinal direction of the air outlet 6 as illustrated in FIG. 8, and the outer-air-passage-wall-recess starting end 24*a* also inclines toward the outer-air-passage-wall central portion 17*b* as illustrated in FIG. 9. Thus, the air passage for the blown air F2 is continuously narrowed toward the two ends in the longitudinal direction of the air outlet 6. With the inner air-passage wall 21 and the outer air-passage wall 23 having such shapes, the blown air F2 gathers toward the inner-air-passage-wall-recess sidewall 22*c* and the outer-air-passage-wall-recess sidewall 24*c*, whereby the wind speed of the blown air F2 is increased at the two ends of the air outlet 6. Consequently, the occurrence of dew condensation near the air outlet 6 is prevented.

Embodiment 3

While Embodiments 1 and 2 each have been described about, as an exemplary air-conditioning apparatus, a ceiling-concealed air-conditioning apparatus including a turbofan as a fan and a heat exchanger provided on the downstream side of the turbofan, the present invention is not limited thereto and is also applicable to a ceiling-concealed air-conditioning apparatus including a cross-flow fan facing the ceiling surface as described in Embodiment 3.

Figure 10:
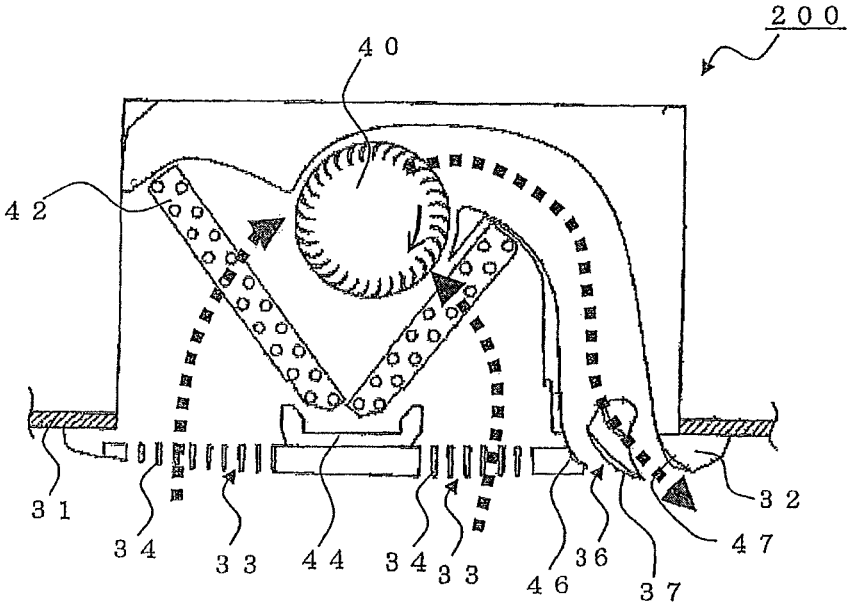
FIG. 10 is a vertical sectional view of a ceiling-concealed air-conditioning apparatus according to Embodiment 3 including a cross-flow fan.

FIG. 10 is a sectional view of a ceiling-concealed air-conditioning apparatus 200 according to Embodiment 3 including a cross-flow fan. As illustrated in FIG. 10, the air-conditioning apparatus 200 includes a decorative panel 32 having a substantially square plan-view shape and provided at the bottom of the air-conditioning apparatus 200. The decorative panel 32 extends along a ceiling 31. The decorative panel 32 has suction grilles 34 that provide air inlets 33 to the air-conditioning apparatus 200. An air outlet 36 is provided extending along one side of the decorative panel 32. A movable wind vane 37 that changes the direction of blown air is provided in each air outlet 36. Air that is sucked from the air inlets 33 into the air-conditioning apparatus 200 is exchanged heat in a heat exchanger 42, is blown by a cross-flow fan 40, and flows out of the air outlet 36. The heat exchanger 42 has a V-sectional shape, on the inner side of which the cross-flow fan 40 is provided. A drain pan 44 is provided below the vertex of the heat exchanger 42 having a V-sectional shape. When the air-conditioning apparatus 200 is not in operation, the wind vane 37 is positioned in such a manner as to close the air outlet 36. When the air-conditioning apparatus 200 is activated, the wind vane 37 is rotated by a non-illustrated driving device such as a motor. In this state, the tip of the wind vane 37 projects from the aperture plane of the air outlet 36. The blown air F2 from the air outlet 36 flows along the wind vane 37. Therefore, controlling the movement of the wind vane 37 controls the direction of the blown air F2. The air outlet 36 is defined by an inner air-passage wall 46 and an outer air-passage wall 47. The shapes of the inner air-passage wall 46 and the outer air-passage wall 47 are the same as those of the inner air-passage walls 16 and 21 and the outer air-passage walls 17 and 23 described in Embodiments 1 and 2.

As described above, the air-conditioning apparatus 200 according to Embodiment 3 includes the cross-flow fan 40. A turbofan is characterized by having a higher static pressure than a cross-flow fan. Therefore, changes in the air-sending characteristic of the turbofan are small relative to changes in the draft resistance due to changes in the shape of the air outlet. In contrast, the cross-flow fan is susceptible to changes in the draft resistance. Therefore, in a case where the occurrence of dew condensation is avoided by providing a straightening vane or the like, the air-sending characteristic, which may not be deteriorated in the case of the turbofan, may be deteriorated in the case of the cross-flow fan, resulting in a reduction in the air flow rate. In such a case, Embodiment 3 of the present invention is particularly effective. This is because no elements are provided in the air passage, and the increase in the draft resistance to the main stream is reduced as much as possible only by utilizing the shapes of the air-passage walls while the problem of dew condensation is addressed by utilizing airflows, as side streams, occurring near the air-passage walls.

While Embodiments 1 to 3 each concern a ceiling-concealed air-conditioning apparatus, the present invention is also applicable to air-conditioning apparatuses to be mounted on room walls.

INDUSTRIAL APPLICABILITY

The present invention is applicable to air-conditioning apparatuses that are capable of cooling operations.

REFERENCE SIGNS LIST

1: ceiling, 2: decorative panel, 3: air inlet, 4: suction grille, 5: filter, 6: air outlet, 6*a*: air-outlet sidewall, 7: wind vane, 8*a*: top board, 8*b*: side board, 9: heat-insulating member, 10: fan, 11: fan motor, 12: heat exchanger, 13: fan-outlet air passage, 14: drain pan, 15: unit elbow air passage, 16: inner air-passage wall, 16*a*: inner-air-passage-wall end portion, 16*b*: inner-air-passage-wall central portion, 16*c*: inner-air-passage-wall downstream end portion, 16*d*: inner-air-passage-wall stepped portion, 17: outer air-passage wall, 17*a*: outer-air-passage-wall end portion, 17*b*: outer-air-passage-wall central portion, 17*c*: outer-air-passage-wall downstream end portion, 18: bellmouth, 19: inner-air-passage-wall recess, 19*a*: inner-air-passage-wall-recess starting end, 19*b*: inner-air-passage-wall-recess terminal end, 19*c*: inner-air-passage-wall-recess sidewall, 20: outer-air-passage-wall recess, 20*a*: outer-air-passage-wall-recess starting end, 20*b*: outer-air-passage-wall-recess terminal end, 20*c*: outer-air-passage-wall-recess sidewall, 21: inner air-passage wall, 21*a*: inner-air-passage-wall end portion, 21*b*: inner-air-passage-wall central portion, 21*c*: inner-air-passage-wall downstream end portion, 22: inner-air-passage-wall recess, 22*a*: inner-air-passage-wall-recess starting end, 22*b*: inner-air-passage-wall-recess terminal end, 22*c*: inner-air-passage-wall-recess sidewall, 23: outer air-passage wall, 23*a*: outer-air-passage-wall end portion, 23*b*: outer-air-passage-wall central portion, 23*c*: outer-air-passage-wall downstream end portion, 24: outer-air-passage-wall recess, 24*a*: outer-air-passage-wall-recess starting end, 24*b*: outer-air-passage-wall-recess terminal end, 24*c*: outer-air-passage-wall-recess sidewall, 31: ceiling, 32: decorative panel, 33: air inlet, 34: suction grille, 36: air outlet, 37: wind vane, 40: cross-flow fan, 42: heat exchanger, 44: drain pan, 46: inner air-passage wall, 47: outer air-passage wall, 100, 200: air-conditioning apparatus.

The invention claimed is:

1. An air-conditioning apparatus comprising walls that form an air passageway terminating in an air outlet blowing out air that has exchanged heat in a heat exchanger, wherein the walls of the air outlet are defined by an inner air-passage wall and an outer air-passage wall extending in a longitudinal direction of the air passageway and by air outlet sidewalls in a short-side direction, wherein each of the inner air-passage wall and the outer air-passage wall includes a plurality of recesses extending in the longitudinal direction of the air passageway, the recesses being provided at the right end and left end in the inner air-passage wall respectively and at the right end and left end in the outer air-passage wall respectively, the recesses each having a width in the longitudinal direction on a downstream side of the air passageway adjacent the air outlet smaller than a width in the longitudinal direction on an upstream side of the air passageway, and wherein a depth of each recess in a middle portion between the upstream side and the downstream of the air passageway is deeper than a depth of each recess of the upstream side and the downstream side.

2. The air-conditioning apparatus of claim 1, further comprising:

a recess sidewall provided to form a step between each of the end portions and the central portion of the inner air-passage wall or the outer air-passage wall, the inner air-passage wall and the outer air-passage wall forming the recesses in the end portions, the step corresponding to one of the recesses, wherein the recess sidewall is at an angle of inclination θ with respect to a direction that is orthogonal to the longitudinal direction of the air outlet, and a width, in the longitudinal direction, of each of the end portions of the walls is continuously reduced from the upstream side toward the downstream side of the air.

3. The air-conditioning apparatus of claim 1, wherein edges of the end portions on the upstream side of the air incline with respect to an edge of the central portion corresponding to the end portions on the upstream side of the air.

4. The air-conditioning apparatus of claim 2, wherein the angle of the inclination θ is 20° to 60°.

5. The air-conditioning apparatus of claim 1, wherein the walls include the inner air-passage wall having a concave curved surface and the outer air-passage wall having a convex curved surface, and the inner air-passage wall and the outer air-passage wall have the recesses, and the recesses of the inner air-passage wall face the recesses of the outer air-passage wall.

6. The air-conditioning apparatus of claim 1, wherein a blowing angle at each of the end portions having the respective recesses is smaller than that at the central portion of the inner air-passage wall, the blowing angle being formed by the inner air-passage wall having the recesses in the end portions from a horizontal direction at an end portion on the downstream side of the air.

7. The air-conditioning apparatus of claim 3, wherein edges of the end portions of the walls on the upstream side of the air each incline in such a direction that a depth of the recess is reduced toward a terminal end thereof in the longitudinal direction of the air outlet.

8. An air-conditioning apparatus comprising:

an air outlet configured to blow heat-exchanged air from a heat exchanger out of the air-conditioning apparatus, the air outlet having walls comprising:

an inner air-passage wall extending in a longitudinal direction of the air outlet and including a central portion and opposing end portions;

an outer air-passage wall extending in the longitudinal direction and including a central portion and opposing end portions, the outer air-passage wall facing the inner air-passage wall;

each end portion of the inner air-passage wall and the outer air-passage including a recess;

air-outlet sidewalls extending in a short-side direction of the air outlet and together with the inner air-passage wall and the outer air-passage wall forming an air passage of the air outlet; and a length of the air passage extending from and including an upstream side receiving the heat-exchanged air from the heat exchanger, past a middle portion and up to and including a downstream side discharging the heat-exchange air out of the air conditioner, wherein the end portions of the inner and outer air-passage walls each have an upstream side, a downstream side and a middle portion corresponding to the upstream side, the downstream side and the middle portion of the air passage, the central portions are wider than the end portions of the inner and outer air-passage walls, the downstream side of each recess has a smaller width than the upstream side of each recess, and the middle portion of each recess has a depth deeper than the upstream side and the downstream side of each recess.

9. The air-conditioning apparatus of claim 8, wherein the air outlet further comprises:

a recess sidewall having a step arranged between the end portions and the central portion of the inner air-passage wall or the outer air-passage wall, wherein the recess sidewall has an angle of inclination θ with respect to a direction that is orthogonal to the longitudinal direction of the air outlet, and a width in the longitudinal direction of each of the end portions of the walls is continuously reduced from the upstream side toward the downstream side of the air passage.

10. The air-conditioning apparatus of claim 9, wherein the angle of the inclination θ is 20° to 60°.

11. The air-conditioning apparatus of claim 8, wherein the inner air-passage wall has a concave curved surface and the outer air-passage wall has a convex curved surface, and the inner air-passage wall and the outer air-passage wall have the recesses, and the recesses of the inner air-passage wall face the recesses of the outer air-passage wall.

12. The air-conditioning apparatus of claim 8, wherein a blowing angle is formed by the inner air-passage wall having the recesses in the end portions from a horizontal direction at an end portion on the downstream side of the air passage, and the blowing angle at each of the end portions having the recesses is smaller than that at the central portion of the inner air-passage wall.

13. The air-conditioning apparatus of claim 8, wherein the end portions on the upstream side of the air passage have edges that incline with respect to an edge of the central portion corresponding to the end portions on the upstream side of the air passage.

14. The air-conditioning apparatus of claim 13, wherein the edges each incline in a direction that reduces a depth of the recess toward a terminal end of the recess in the longitudinal direction of the air outlet.

* * * * *